United States Patent [19]

Fried

[11] Patent Number: 5,077,002

[45] Date of Patent: Dec. 31, 1991

[54] PROCESS FOR SHAPING ANY DESIRED COMPONENT USING A POWDER AS THE STARTING MATERIAL

[75] Inventor: Reinhard Fried, Nussbaumen, Switzerland

[73] Assignee: Asea Brown Boveri Ltd., Baden, Switzerland

[21] Appl. No.: 668,210

[22] Filed: Mar. 12, 1991

[30] Foreign Application Priority Data

Mar. 14, 1990 [CH] Switzerland ..... 817/90

[51] Int. Cl.[5] ..... C21D 1/00

[52] U.S. Cl. ..... 419/29; 419/60; 419/49; 264/65; 264/125

[58] Field of Search ..... 419/49, 60, 29

[56] References Cited

U.S. PATENT DOCUMENTS

| | | | |
|---|---|---|---|
| Re. 31,355 | 8/1983 | Rozmus | 419/49 |
| 1,788,101 | 1/1931 | Gates | 264/157 |
| 3,622,313 | 11/1971 | Havel | 75/226 |
| 3,939,241 | 2/1976 | Powell et al. | 264/111 |
| 4,164,527 | 8/1979 | Bakul et al. | 264/60 |
| 4,199,339 | 4/1980 | Grunke | 65/18 |
| 4,673,549 | 6/1987 | Ecer | 419/10 |
| 4,722,825 | 2/1988 | Goldstein | 419/8 |
| 4,724,123 | 2/1988 | Rozmus, Jr. | 419/68 |
| 4,943,320 | 7/1990 | Pechnik et al. | 75/235 |

FOREIGN PATENT DOCUMENTS

| | | |
|---|---|---|
| 0053753 | 6/1982 | European Pat. Off. . |
| 0191409 | 8/1986 | European Pat. Off. . |
| 0203789 | 12/1986 | European Pat. Off. . |
| 3805193 | 8/1989 | Fed. Rep. of Germany . |
| 2310825 | 12/1976 | France . |
| 2353355 | 12/1977 | France . |
| 2435310 | 4/1980 | France . |
| 2088414 | 6/1982 | United Kingdom . |

*Primary Examiner*—Stephen J. Lechert, Jr.
*Attorney, Agent, or Firm*—Burns, Doane, Swecker & Mathis

[57] ABSTRACT

Process for shaping any desired metallic and/or ceramic component, in which a dry powder is filled loosely into a ceramic mold, which elastically/plastically yields or cracks and breaks under the influence of shrinkage stresses during sintering, and is sintered. Variants for the mold: thin, resilient shells made of $Al_2O_3$, $SiO_2$ or MgO; special glass which cracks in a network-like manner; a mold having predetermined breaking points, ceramic shell disintegrating into fragments; flexible green ceramic sheeting; green ceramic composition with shrinkage during sintering.

16 Claims, 10 Drawing Sheets

PROCESS FOR SHAPING ANY DESIRED COMPONENT USING A POWDER AS THE STARTING MATERIAL

BACKGROUND OF THE INVENTION

1. Field of the invention

The invention relates to production of complex components made of metallic or ceramic materials, powders being used as the starting materials. The invention also addresses questions with regard to sintering and hot-isostatic pressing in respect of shrinkage.

The invention relates to the further development, perfection and simplification of powder-metallurgical production methods for the production of workpieces of comparatively complex shapes, where the problems of shrinkage during sintering play an important role. The field of application is, in particular, the component sector in turbine construction.

In a narrower sense, the invention relates to a process for shaping any desired component made of a metallic and/or ceramic material using a powder or a powder mixture as the starting material, the powder being filled loosely into a mold and then subjected to a sintering process.

2. Discussion of Background

Powders are used as the starting materials in numerous production methods in the metallurgical and ceramics industries. Powder-metallurgical processes have the advantage that virtually any desired shape can be achieved. The intention is to produce workpieces by powder metallurgy as finished articles in order to be able to save on some or all expensive machining costs. The starting materials in all of the known processes for obtaining net shapes or near-net shapes of the workpieces are slurries (slip, paste) of powders in solvents using a binder. The following are used as additives to powder mixtures:

water+binder+additive (slip casting, freeze drying).

water+cellulose (metal-powder injection molding (MIM) by the Rivers process).

thermoplastics (metal-powder injection molding).

With all of these wet-mechanical methods numerous difficulties arise with regard to quality, freedom of shaping, reproducibility and choice of the composition:

Bubble formation when mixing powder with binder and solvent.

Restriction of the wall thickness of the workpieces pieces (for example max. 5–10 mm for "MIM"), since otherwise the binder can no longer be completely removed.

The occurrence of binder residues (for example carbon), which, even after "burning out" the binder, remain behind in the workpiece and can impair its composition in an uncontrolled manner.

The necessity for fresh selection/fresh development of the binder when changing to other shapes and/or compositions of the workpieces.

The following publications are cited in respect of the prior art:

GB Pat. Appl. 2088414.

EP Pat. Appl. 0191409.

R. Billet, "PLASTIC METALS: From Fiction to Reality with Injection Molded P/M Materials", Parmatech Corporation, San Rafael, Calif., P/M-82 in Europe Int. PM-Conf. Florence I 1982.

Göran Sjöberg, "Powder Casting and Metal Injection Moulding", manuscript submitted to Metal Powder Report September 1987.

The known processes leave something to be desired. There is therefore a need for improvement and further development of the powder-metallurgical/powder-ceramic production methods.

SUMMARY OF THE INVENTION

The object on which the invention is based is to indicate a process with which it is possible, using metal or ceramic powders as starting materials, to produce a workpiece of comparatively complex shape and of any desired cross-section and unlimited wall thickness. The process should provide a reproducible finished product which requires no further, or at most slight, additional machining. During powder processing bubbles and undesirable harmful residues should be avoided. The process should ensure the maximum possible freedom and universality in respect of the choice of shape and of the composition of the workpiece to be produced.

This object is achieved in that, in the process mentioned initially, the mold used is a yielding ceramic body which yields elastically and/or plastically and/or cracks at predetermined breaking points provided in a targeted manner, under the stresses which arise during the rise in temperature and during sintering as a consequence of expansion or shrinkage and cause tensile and/or compressive forces, its strength and dimensional stability, however, being sufficiently high, considered in the entire temperature range and over the entire course of the process, to ensure a high dimensional accuracy of the component to be produced as a sintered compact.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
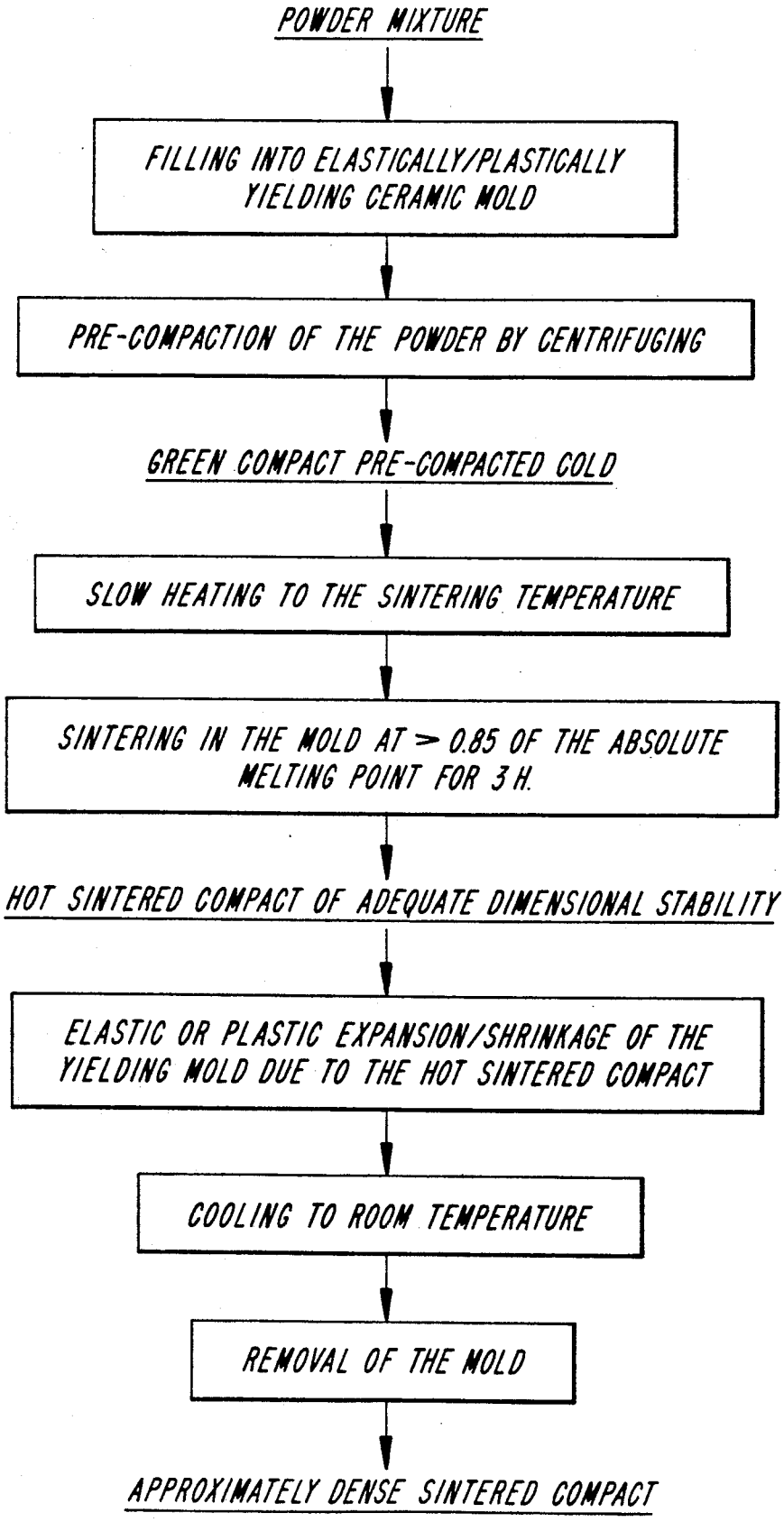
FIG. 1 shows a flow sheet (block diagram) of the process using an elastically/plastically yielding mold.

Referring now to the drawings, wherein like reference numerals designate identical or corresponding parts throughout the several views, in FIG. 1 a flow sheet (block diagram) of the process using an elastically/plastically yielding mold is shown. The diagram requires no further explanation. The mold consists of a resilient material and is designed such that it follows the movements of the sintered compact to be produced, without cracking or breaking.

Figure 2:
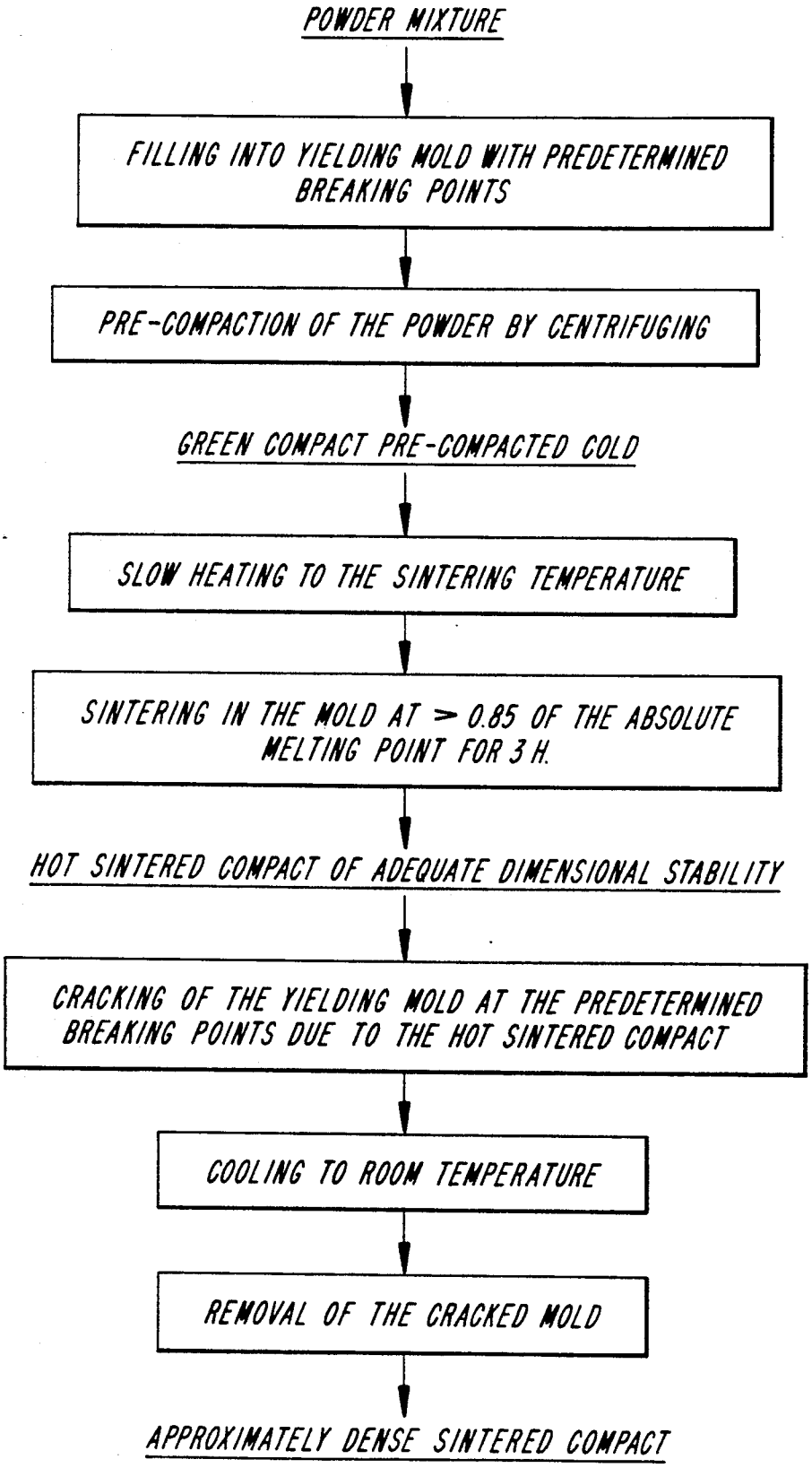
FIG. 2 shows a flow sheet (block diagram) of the process using a yielding mold having predetermined breaking points.

FIG. 2 shows a flow sheet (block diagram) of the process using a yielding mold having predetermined breaking points. This diagram also requires no further comment. The mold in this case consists of a material which breaks at certain points as soon as the compact to be sintered has sufficient inherent strength. The mold broken or cracked in this way then offers no further significant resistance to the solidifying sintered compact, so that it can expand or contract in all directions without being severely hindered. It should be pointed out here that this category of mold design covers all variants in which the mold undergoes more or less irreversible changes in the course of the sintering process of the workpiece: the mold cracks, breaks, disintegrates or is at least locally crushed, etc. The mold does not necessarily have to have precisely prearranged predetermined breaking points such as notches, grooves etc. The "predetermined breaking point" can also be established arbitrarily at any point at which the strength of the material is exceeded. After the sintering process, the destroyed mold is not simply ready for use again.

Figure 3:
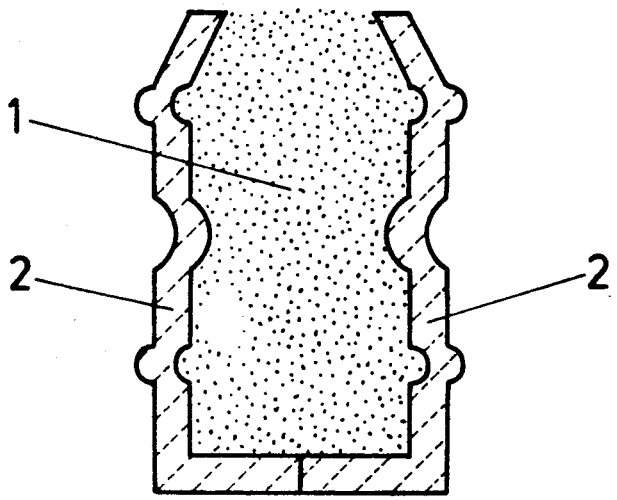
FIG. 3 shows a diagrammatic outline/section of a yielding, divided mold with powder fill for the purpose of demonstrating the principle of mold yielding during shrinkage: status before shrinkage.

FIG. 3 relates to a diagrammatic outline/section of a yielding, divided mold with powder fill for the purpose of demonstrating the principle of mold yielding during shrinkage: status before shrinkage. 1 represents the powder fill (loose powder fill) for the component. 2 is a yielding, divided mold made of ceramic material in the status before shrinkage of the component (heat treatment, sintering process).

Figure 4:
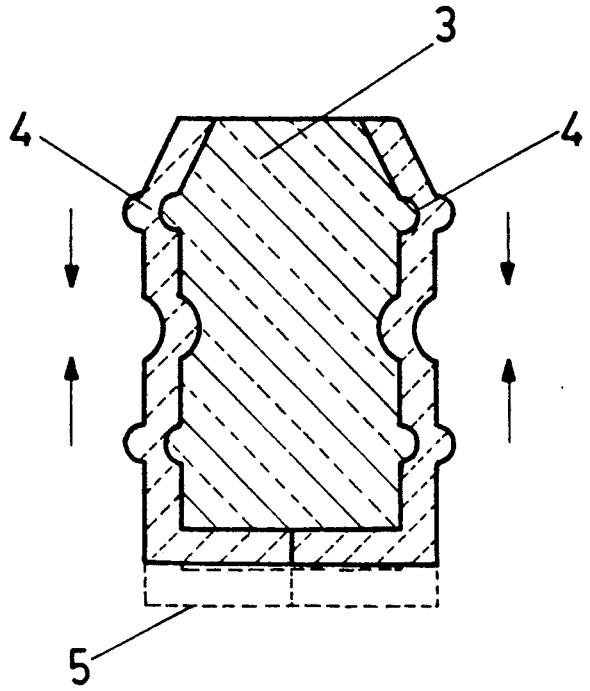
FIG. 4 shows a diagrammatic outline/section of a yielding, divided mold with sintered compact for the purpose of demonstrating the principle of mold yielding during shrinkage: status during shrinkage.

FIG. 4 shows a diagrammatic outline/section of a yielding, divided mold with sintered compact, for the purpose of demonstrating the principle of mold yielding during shrinkage: status during shrinkage (also after completion of the shrinkage process during the sintering process). 3 is the solidifying sintered compact (component, workpiece) formed in the meantime from the powder. 4 represents the yielding, divided mold made of ceramic material during and after the shrinkage of the component. For reasons of clarity, the shrinkage has been drawn in the figure only in the direction of the main longitudinal axis, whilst that in the transverse direction has been left out of account. The direction of movement during the shrinkage process of the component is indicated by vertical arrows in opposite directions to one another. These arrows at the same time represent the longitudinal compressive forces acting on the ceramic mold. The mold is thus crushed in the present case. 5 is the original outline (broken line) of the yielding mold before shrinkage of the component (cf. FIG. 3).

Figure 5:
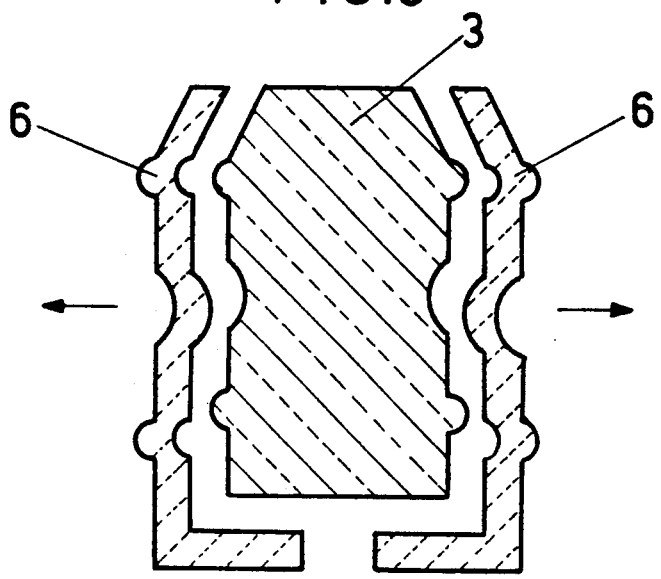
FIG. 5 shows a diagrammatic outline/section of a yielding, divided mold and a finished sintered compact for the purpose of demonstrating the principle of mold yielding during shrinkage: status after removal of the divided mold.

FIG. 5 shows a diagrammatic outline/section of a yielding, divided mold and a finished sintered compact for the purpose of demonstrating the principle of mold yielding during shrinkage: status after removal of the filled mold. 3 is the sintered compact and 6 the divided mold made of ceramic material, after its removal. After removal of the stress, the elastic mold (two halves in the present case) returns approximately to its original shape. The arrows show the direction of movement of the mold parts when they are removed from the workpiece.

Figure 6:
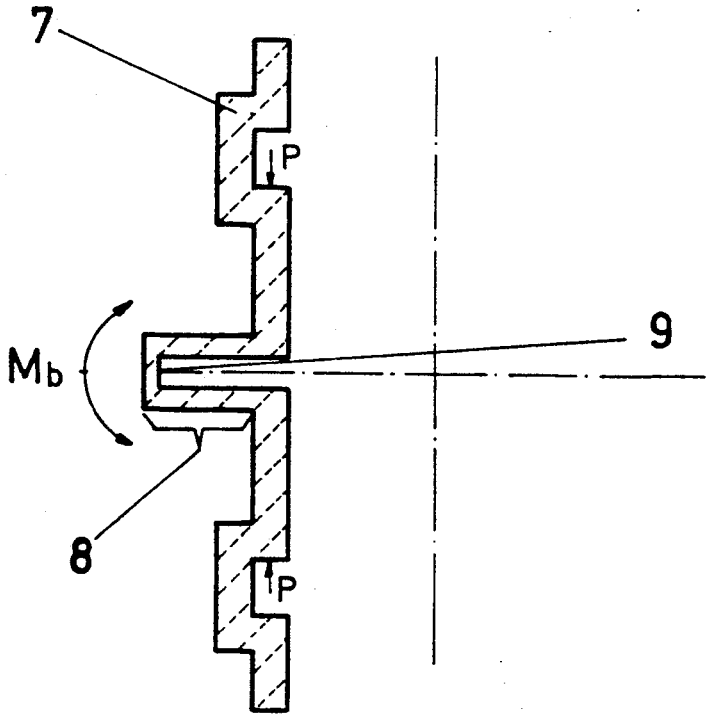
FIG. 6 shows a diagrammatic outline/section of a cut-out from a yielding mold for the purpose of demonstrating the principle of the predetermined breaking point during shrinkage.

FIG. 6 shows a diagrammatic outline/section of a cut-out from a yielding mold for the purpose of demonstrating the principle of the predetermined breaking point during shrinkage. 7 is any desired cut-out from a yielding mold made of ceramic material. This stylized example can without any problem be transferred to the case of the lateral boundary of a turbine blade having projecting top and foot parts. 8 represents an expansion piece (bulge, bead) of the yielding mold. This part serves to divert the forces (compressive forces p) and to generate a bending moment ($M_b$) at the predetermined breaking point 9, which is subjected to bending strain during shrinkage of the component. Moreover, by means of a bulge of this type the space is provided for the movement of the mold caused by the shrinkage of the component.

Figure 7:
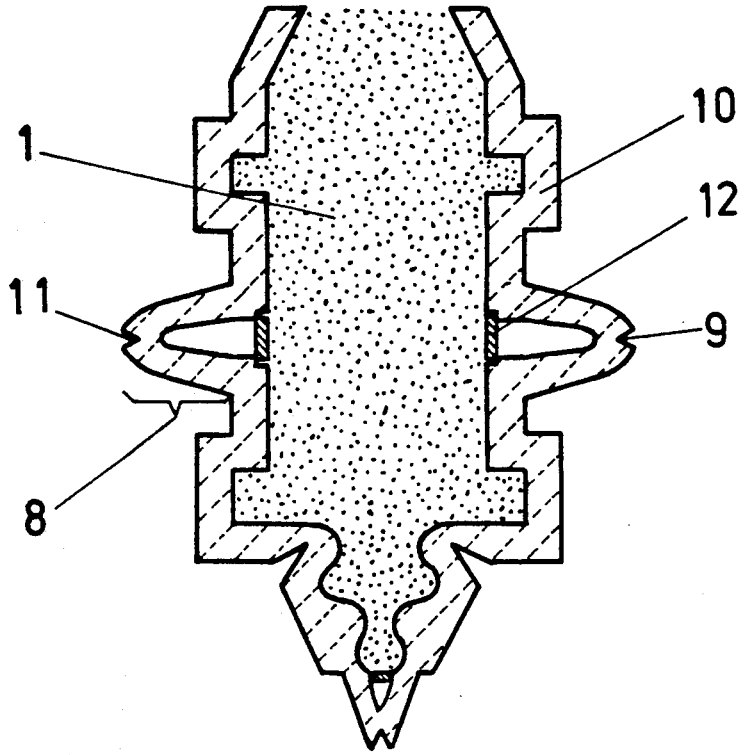
FIG. 7 shows a diagrammatic outline/section of a yielding mold with predetermined breaking points and a powder fill: status before shrinkage.

FIG. 7 relates to a diagrammatic outline/section of a yielding mold with predetermined breaking points and a powder fill: status before shrinkage. 1 is the powder fill for the component and 10 the yielding, undivided mold made of ceramic material and having predetermined breaking points, before shrinkage of the component. 8 is an expansion piece in the shape of a parabola-like bulge with predetermined breaking point 9 in the form of a notch (groove) 11. The space surrounded by the expansion piece 8 is sealed towards the workpiece side by an elastic/plastic ceramic seal 12 in the form of a nonwoven or felt or resilient fiber product.

Figure 8:
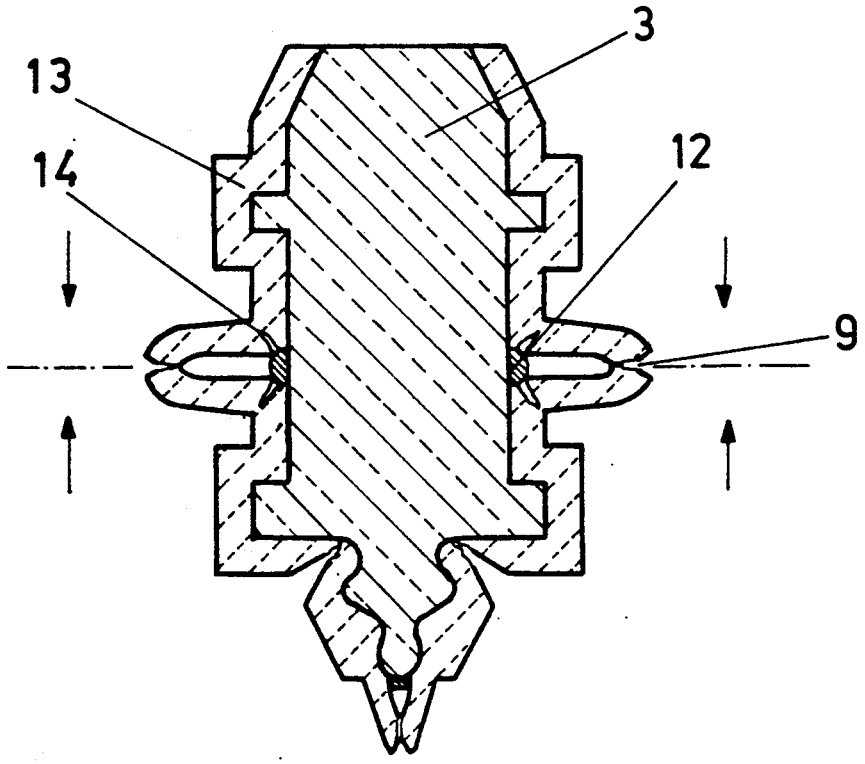
FIG. 8 shows a diagrammatic outline/section of a yielding mold with broken predetermined breaking points and a sintered compact: status during shrinkage on sintering.

FIG. 8 shows a diagrammatic outline/section of a yielding mold with broken predetermined breaking points and a sintered compact: status during shrinkage on sintering. 3 is the sintered compact shown as shrunk in the longitudinal direction compared with the powder fill 1 (FIG. 7). 9 is in each case one predetermined breaking point (mold already broken). 13 is in each case one part of the yielding, undivided mold made of ceramic material during and after shrinkage of the component. 12 is the elastic/plastic ceramic seal, which here has been partially squashed by crushing in the transverse available space. 14 represents a crack in one part of the mold made of ceramic material during and after shrinkage of the component. In the case under consideration, the crack 14 gapes at this point as a result of a high bending moment. On severe shrinkage, the projecting expansion pieces (8 in FIG. 7) break off completely or are even crushed.

Figure 9:
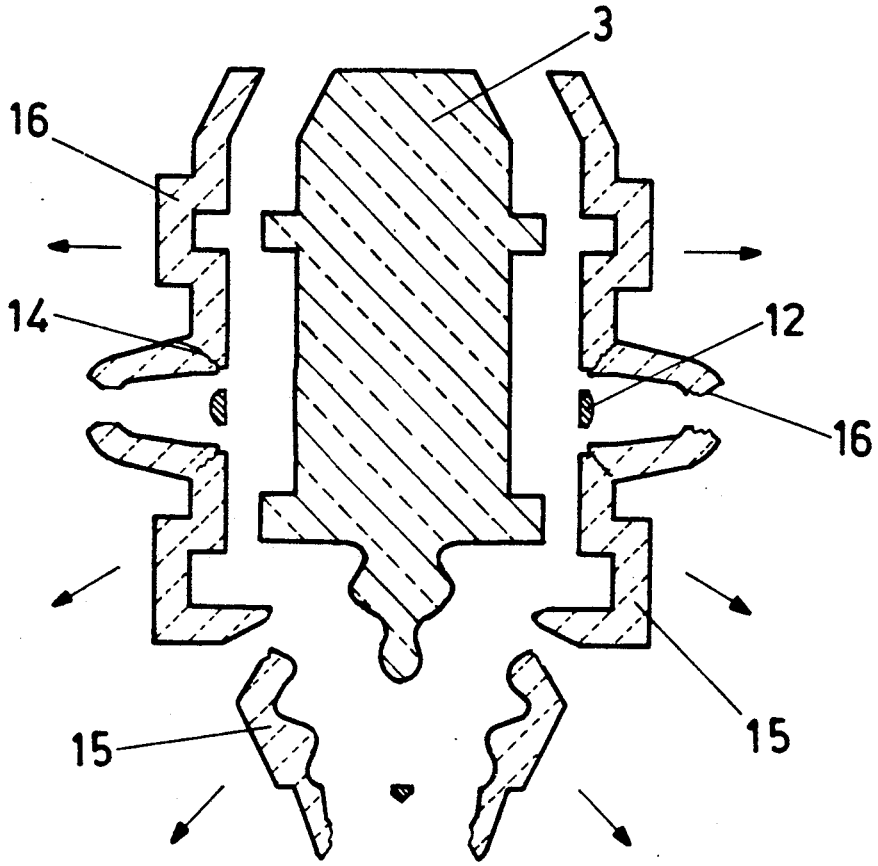
FIG. 9 shows a diagrammatic outline/section of a yielding mold with broken predetermined breaking points and a finished sintered compact: status after removal of the fragments of the cracked mold.

FIG. 9 shows a diagrammatic outline/section of a yielding mold with broken predetermined breaking points and a finished sintered compact: status after removal of the fragments of the cracked mold. 3 is the sintered compact, 12 the elastic/plastic ceramic seal and 15 in each case a fragment of the yielding mold made of ceramic material, after removal. 16 is an irregular fracture surface at the predetermined breaking point of the mold. The crack 14 in a fragment is drawn in as a solid line after removal of the bending moment. In contrast to this, the lowermost fragments 15 are completely broken through. They are all variants of the destroyed mold. The arrows indicate the direction of movement of the fragments 15 when they are removed from the component to be produced.

Figure 10:
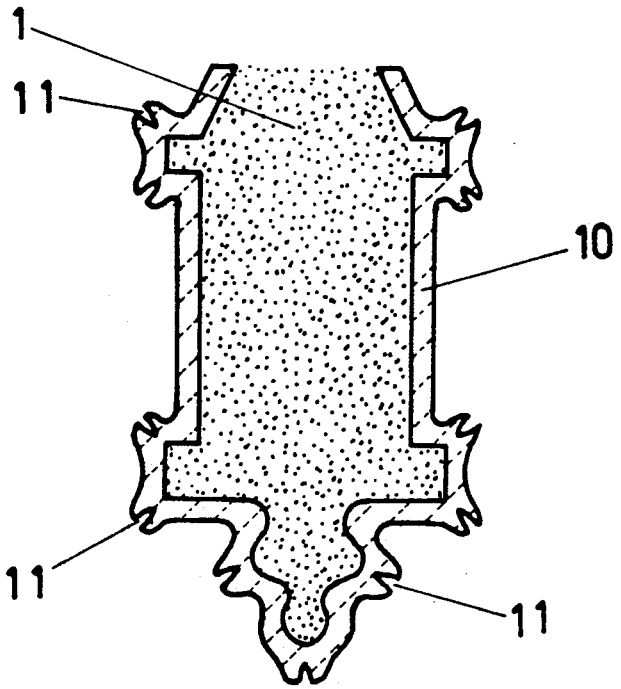
FIG. 10 shows a diagrammatic outline/section of a thin-walled mold with numerous notches as predetermined breaking points and a powder fill: status before shrinkage.

FIG. 10 shows a diagrammatic outline/section of a thin-walled, yielding mold with numerous notches as predetermined breaking points and a powder fill: status before shrinkage. In principle, the reference numerals correspond to those in FIG. 7. The wall thickness of the mold 10 is greatly reduced compared with FIG. 5. The notches 11 of the predetermined breaking points have a parabolic section and are located predominantly at the thickened corners of the mold 10. By this means bending moments are generated on shrinkage which cause the shell-like mold 10 to break.

Figure 11:
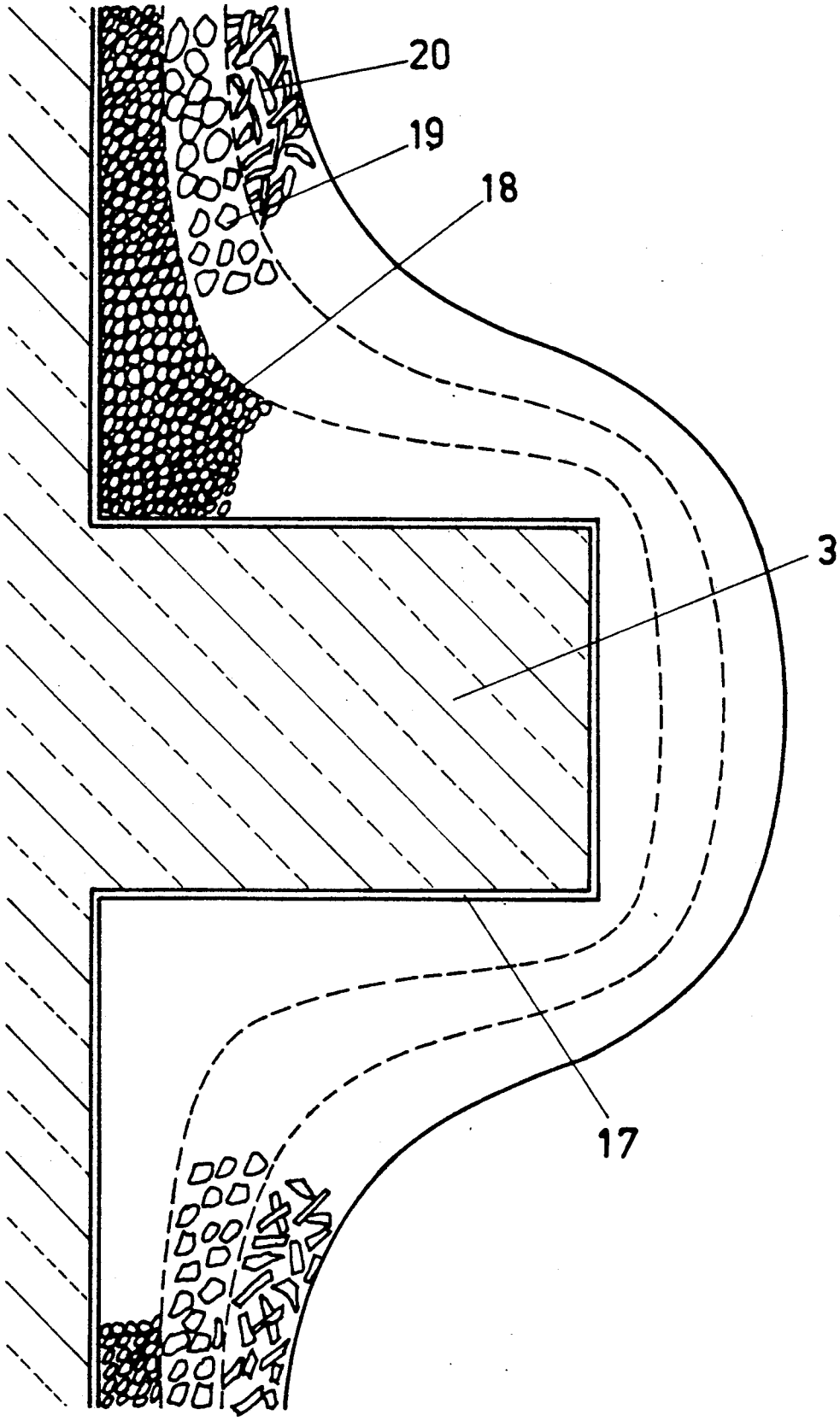
FIG. 11 shows a diagrammatic section of a cut-out from a mold, consisting of several ceramic layers, and a sintered compact.

FIG. 11 relates to a diagrammatic section of a cut-out from a mold, consisting of several ceramic layers, and a sintered compact. The detail shows a sintered compact 3 at the location of a rib having a rectangular cross-section. In the case under consideration, the mold is a shell-like body composed of various layers. 17 is a smooth inner skin of the mold made of ceramic material. A fine-grained mass, paste (slip etc.) is as a rule used for this purpose. 18 is the medium-fine-grained inner layer (shell) of the mold made of ceramic material, which layer essentially determines the shape. Its relatively densely bedded grains are drawn as more or less globular particles. 19 is the coarse-grained middle layer (shell) of the mold. 20 represents the coarse-pored outer layer of the mold, which layer is constructed as a cage. Its structure is indicated by elongated, rod-shaped particles. Of course, in practice other layer sequences and other particle sizes, structures and compositions of the shells are also produced. The details depend on the nature, shape, alloy, etc. of the component to be produced and can be changed as desired.

Figure 12:
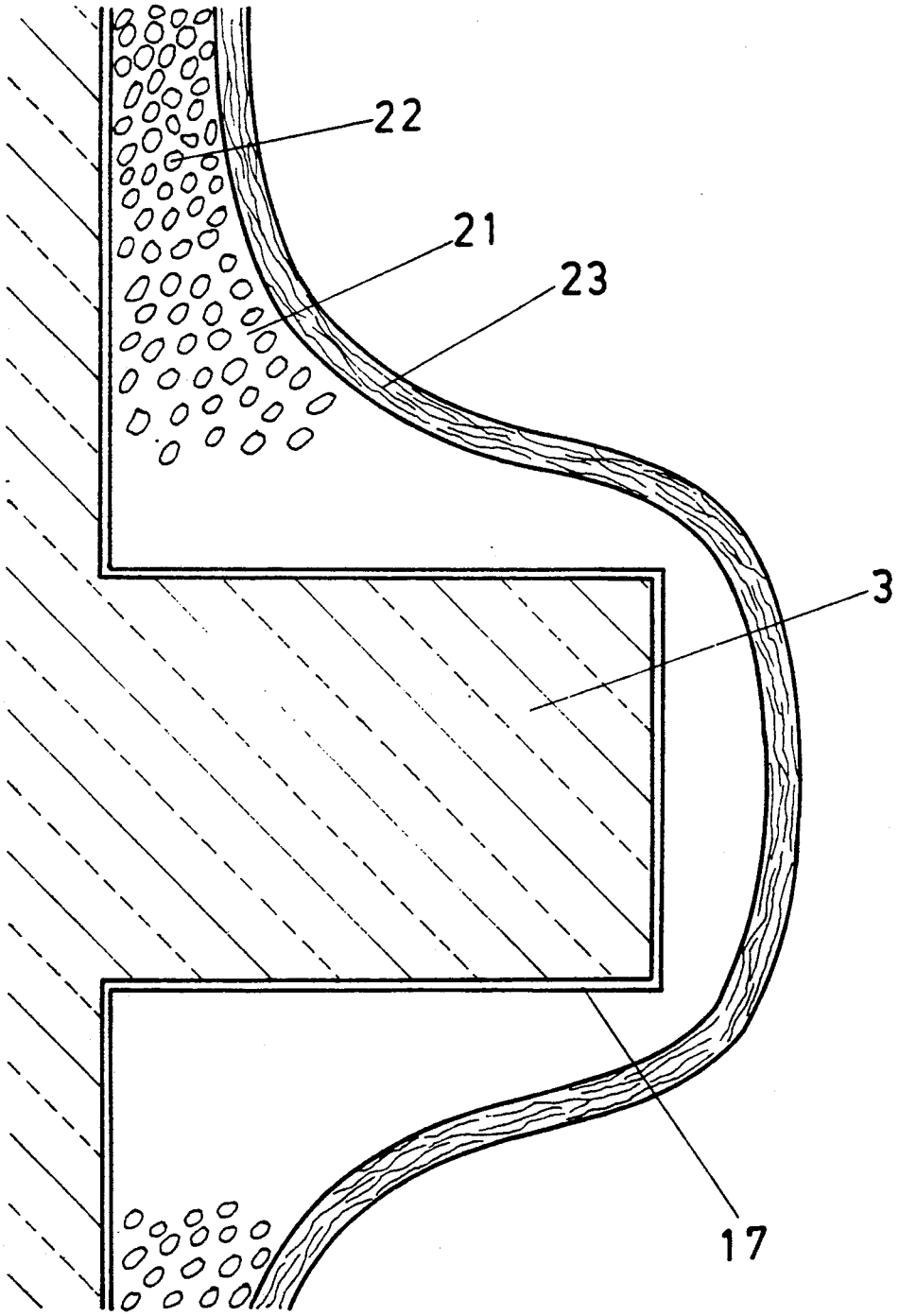
FIG. 12 shows a diagrammatic section of a cut-out from a mold, consisting of a highly porous foam ceramic layer and a mechanically stronger glass ceramic layer, and a sintered compact: status before cracking, during sintering.

FIG. 12 shows a diagrammatic section of a cut-out from a mold consisting of a highly porous foam ceramic layer and a mechanically stronger glass ceramic layer, and a sintered compact: status before cracking during sintering. The smooth inner skin 17 made of ceramic material is located on the inside of the mold, facing the sintered compact 3. 21 is an inner layer (shell) of the mold made of highly porous foam ceramic. The latter has coarse through pores 22. 23 represents an outer layer (shell) of the mold made of glass ceramic (fiber-reinforced).

Figure 13:
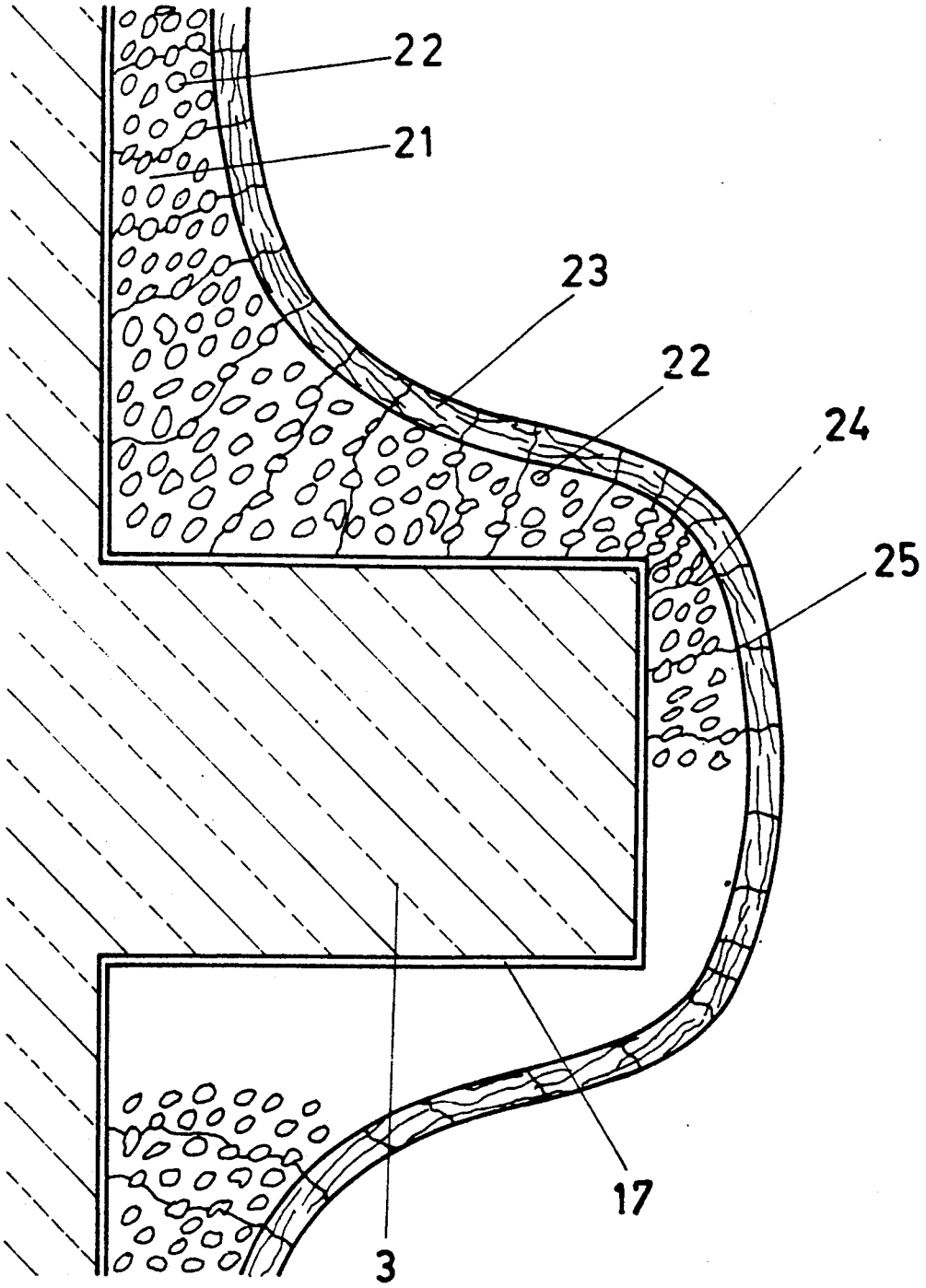
FIG. 13 shows a diagrammatic section of a cut-out from a mold, consisting of a highly porous foam ceramic layer and a glass ceramic layer, and a sintered compact: status after cracking and crumbling.

FIG. 13 shows a diagrammatic section of a cut-out from a mold, consisting of a highly porous foam ceramic layer and a glass ceramic layer, and a sintered compact: status after cracking and crumbling. The reference numerals 3, 17, 21, 22 and 23 are precisely the same as in FIG. 12. 24 is in each case a crack in the foam ceramic of the mold, which runs approximately vertically to the surface of the workpiece (sintered compact 3). The cracks 24 partially follow the pores 22 in this layer 21. 25 is the corresponding crack in the glass ceramic of the mold. The case where tensile and bending stresses arise in the layers 21 and 23 is drawn.

Figure 14:
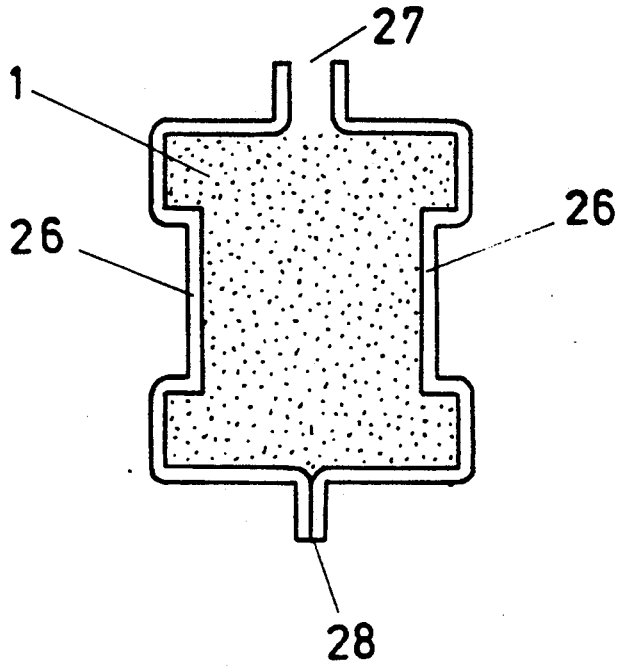
FIG. 14 shows a diagrammatic outline/section of a yielding mold, consisting of a ductile ceramic sheeting, with powder fill: status before shrinkage.

FIG. 14 shows a diagrammatic outline/section of a yielding mold, consisting of a ductile ceramic sheeting, with powder fill: status before shrinkage. 1 is the powder fill for the production of the made 26 is a thin, ductile ceramic sheeting, which is used in the green or semi-dry or partially heat-treated state. It is laid in a pre-mold and, for hardening, is subjected to heat treatment or some other hardening process. The powder is filled into the mold through a fill orifice 27. 28 is a seal (adhesive joint) in the ceramic sheeting.

Figure 15:
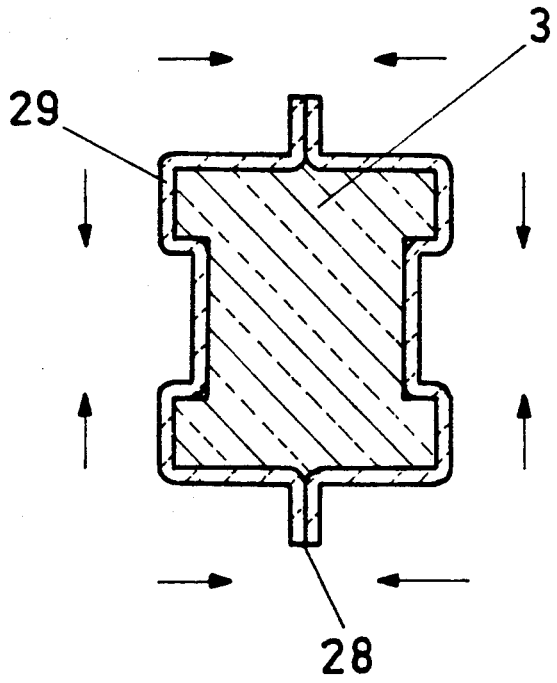
FIG. 15 shows a schematic outline/section of a yielding mold, consisting of a sintered ceramic sheeting, with sintered compact: status after shrinkage by joint sintering.

FIG. 15 relates to a diagrammatic outline/section of a yielding mold, consisting of a sintered ceramic sheeting, with sintered compact: status after shrinkage by joint sintering. 3 is the sintered compact and 20 the shell made of the sintered ceramic sheeting. The arrows indicate the direction of movement during the shrinkage process of the component. Since the shell 29 also shrinks at the same time, only the difference forces come into action at the boundary surfaces between shell 29 and sintered compact 3. Positive or negative difference forces can result, depending on whether the amount of shrinkage of the component or that of the mold predominates. In the first case compressive forces and in the second case tensile forces are generated in the mold (shell 29). It is advantageous mutually to match the amount of shrinkage by selection of the particular materials involved in 3 and 29. A special case arises if both amounts of shrinkage are identical. No forces are then transmitted.

The yielding (i.e. elastic/plastic resilient or cracking ) molds are produced by the known conventional processes of casting and plastic molding technology and related technologies. Accordingly, the mold is usually produced via a model, the dimensions of which take into account the subsequent shrinkage during sintering of the powder to produce the component.

For the production of the one-piece-hollow mold, the method involving melting out of wax, low temperature metals and alloys, washing out of salt or urea, burning out of synthetic foam, etc. is carried out. The ceramic material required for the mold is applied to the model by the dipping, pasting, casting and spraying method.

Multi-part molds are usually produced using models, matrices, pre-molds, etc. Indestructable, elastic-plastic yielding molds are as a rule constructed as thin-walled, highly porous shells, usually built up from several layers. Destructable molds either have pre-determined, defined predetermined breaking points or consist of thin shells which, under the forces which arise, form network-like polygonal cracks or decompose into mosaic-like fragments. These forces can also be generated by process control (temperature, chemical reactions, structural transformations).

ILLUSTRATIVE EMBODIMENT I

The component produced was a blade for a rotary thermal machine and in the case under consideration for an axial compacter. The blade having a wing cross-section had the following final dimensions:

Length = 115 mm
Width = 25 mm
Maximum thickness = 3.6 mm
Section height = 6.5 mm The material selected was a Cr steel having the German DIN designation X20CrMoV 12 1 and having the following composition:

Cr = 12% by weight
Mo = 1% by weight
V = 0.3% by weight
Si = 0.3% by weight
Mn = 0.6% by weight
C = 0.20% by weight
Fe = remainder A powder produced by gas jet atomization and having a maximum particle size of 50 μm was used as the starting material for production of the blade. The powder was filled dry, without any binder, into a yielding ceramic mold, the internal dimensions of which were linearly increased by about 10%, and pre-compacted cold by vibration.

The procedure for the production of the following mold was as follows:

First of all two pre-molds (matrices) for a two-part ceramic mold were produced, which matrices were in the form of a hollow mold for the component to be produced and linearly increased by the amount of shrinkage 10%. A ceramic casting composition based on zirconium silicate having the trade name Durapot 814 from Kager GmbH, Federal Republic of Germany, was filled into these matrices and compacted with a die. The casting composition is a composition to which an activator/water have been added and which cures completely at room temperature after a short pot life (10 min) in 24 h. The two thin-walled (wall thickness about 3 mm) ceramic half-shells produced in this way were subjected to fine machining at the mold seals, cemented together using high-temperature adhesive based on $SiO_2$ to give a butt joint and dried for a further 2 h at a temperature of about 120° C. The mold was not baked further, i.e. it was possible to dispense with a special sintering of the mold.

The sintering of the steel powder filled in and pre-compacted cold was carried out under vacuum (residual pressure $10^{-7}$ bar). The vacuum furnace the workpiece was first heated at a rate of 20° C./min to 1,000° C. and then at a rate of 5° C./min to 1,200° C. In the course of the corresponding heating time, the steel powder had the opportunity to sinter to the extent that the workpiece already had an adequate inherent strength without having suffered significant shrinkage. The workpiece to be sintered was then further heated to a sintering temperature of 1,360° C. and sintered to completion for 6 h. During this operation the yielding ceramic mold, consisting of casting composition sintered at the same time, achieved a state in which it offered virtually no further resistance to the shrinkage of the steel component to be produced, but essentially preserved the shape thereof which it was desired to achieve. The whole was then cooled in the furnace to about 250° C., the shell-like ceramic mold developing cracks because of the differences in the coefficients of thermal expansion and some parts of the shells already broke away. After removal from the furnace, the component, with the parts of the mold shell still adhering thereto, was quenched in cold water, all of the mold shell breaking away. The component was cleaned by blasting with glass beads, by which means a clean, smooth surface was achieved.

ILLUSTRATIVE EMBODIMENT II

The component produced was a blade corresponding to Example I and made of the Cr steel X20CrMoV 12 1 and having the same dimensions. The tools used were the divided metal pre-molds (matrices) as indicated under Example I.

An approximately dry granular-crumbly ceramic compound (granules) based on steatite (Mg/Al silicate), in accordance with German Standard steatite KER 221 DIN 40685, compound 711 from Hutschenreuter, Neustadt, Federal Republic of Germany, was pressed into the matrices. The compound had the following composition:

$SiO_2$ = 60.4% by weight
$Al_2O_3$ = 5.62% by weight
$TiO_2$ = 0.18% by weight
$Fe_2O_3$ = 0.95% by weight
CaO = 1.82% by weight
MgO = 27.0% by weight
$H_2O$ = 0.23% by weight
$Na_2O$ = 0.06% by weight The residual moisture ($H_2O$ content) was about 2.5 to 3% by weight. 0.5% by volume of a binder based on silicate and having the trade name "Silester X15" from Monsanto, Brussels, Belgium, was admixed to the compound containing particles up to 630 μm in size. The compound was filled into the matrix with vibration and pressing with a die. The green compact produced in this way had sufficient inherent strength to be handled for drying. The complete curing of the binder constituent was effected by means of a chemical reaction, by treatment in an $NH_3$-containing atmosphere (ammonia curing) for 5 min. The ceramic mold was then dried in the air for 30 min. The drying time is about 10 to 60 min, depending on the dimensions of the mold. This time was utilized in order to fill the yielding ceramic mold, consisting of shells, with the Cr steel powder. In the case under consideration, it was possible to dispense with a separate baking of the ceramic mold. The filled mold was run into a vacuum furnace, heated and sintered at the same time as the powder for the component to be produced. As a consequence of the low binder content of the mold, the contamination of the furnace atmosphere is negligible. During this heat treatment a considerable shrinkage occurred in the mold, so that the latter at any point in time guaranteed an adequate support of the steel particles of the workpiece without, however, hindering these particles in their own shrinkage. The time/temperature program was controlled in such a way that the shrinkage of the workpiece and of the mold took place at an approximately equal rate and equal extent. In the case under consideration the whole was first heated at a rate of about 10° C./min to 1,100° C., kept at this temperature for 30 min (start of shrinkage in mold and workpiece) and then brought to 1,280° C. and kept at this temperature for 60 min. Cooling took place in the furnace at a rate of about 0.5° C./min. With this program, shrinkage/thermal expansion in the mold and in the workpiece are approximately balanced at any point in time. In this case, the linear shrinkage of the ceramic mold was about 13 to 14% and that of the component (Cr steel) to be produced about 10 to 12%. Therefore, the mold always exerted a certain compressive force on the component surface. At the points at which the tensile stress in the mold wall exceeded the mold strength, the mold cracked slightly. In the sense of the invention, the cracking is, however, desirable, in accordance with the concept of "yielding mold", or is at least not troublesome. The result was a component of very accurate shape having a smooth, dense surface, which is very suitable for post-compaction of the workpiece by container-free hot-isostatic pressing.

ILLUSTRATIVE EMBODIMENT III

A turbine blade having a wing section of the following dimensions was produced:

Length=155 mm
Width=29 mm
Maximum thickness=4.8 mm
Section height=9.5 mm

The material used was a Cr/Ni steel having the designation AISI 316 corresponding to XcCrNiMo 17.12.2 German Standard, having the following composition:

Cr=17% by weight
Mo=2.2% by weight
Ni=12% by weight
Mn=2% by weight
Si=1% by weight
C=0.08% by weight
Fe=remainder The powder used had been produced by gas jet atomization and had a maximum particle size of 30 μm.

First of all a yielding ceramic mold based on $SiO_2$ 2 and consisting of two shells was produced. The principle of the demixing of special silicate glasses forming a multi-phase mixture was applied for this purpose (cf. spinodal demixing). The starting material was a borosilicate glass of the following composition:

$SiO_2$=70% by weight
$B_2O_3$=20% by weight
$Na_2O$=20% by weight 3 mm thick shells were produced from the borosilicate glass with the aid of matrices as tools and cemented together and the mold formed in this way was subjected to a heat treatment. During this treatment the borosilicate demixed into a virtually pure, insoluble $SiO_2$ phase and a local sodium borate phase. The latter was dissolved out using 3 N sulfuric acid, so that a microporous $SiO_2$ skeleton retaining the shape of the mold remained behind. The Cr/Ni steel powder was filled into this mold and the whole heated to 1,000° C. From 900° C, the steel powder sintered successively to such an extent that it already acquired a sufficient inherent strength. At the same time, the spongy skeleton of the mold underwent linear shrinkage of 15 to 20%. During this shrinkage the mold partially burst, whilst other parts thereof softened. Just before the mold reached this state, a pressure was exerted on the workpiece, vertically to the surface, which pressure effected at least a local compaction of said surface. This effect is desirable, since it leads to a denser component.

In a variant, the complete sintering, which aims to produce a component which is as dense as possible, was dispensed with and the entire heat treatment was discontinued prematurely (pre-sintering). The whole, the component and the mold surrounding the workpiece as a glass casing, was cooled and compacted in an appropriate installation by hot-isostatic pressing to give the finished component. With this procedure the glass and time/temperature program were matched to one another beforehand in such a way that neither recrystallization nor fracture as a result of stresses arising at the $SiO_2$ transformation were to be feared.

ILLUSTRATIVE EMBODIMENT IV

A blade corresponding to Example II was produced from Cr/Ni steel AISI 316. The dimensions were precisely the same as in Example III. The same matrices were also used.

A pasty composition of a foaming ceramic material based on sodium metasilicate was first applied by spraying/spray-coating to the positive mold section of the particular matrix, dried, cured and detached from the matrix. The two thin shells produced in this way had a wall thickness of 0.5 mm. They were stuck together to form the yielding ceramic mold and filled with Cr/Ni steel powder. The whole, consisting of mold and workpiece consisting of powder fill, was then placed in a box containing a sand bed, surrounded by sand on all sides and heated to a temperature of 600° C. During heating up, the ceramic composition of the mold started to foam up, a highly porous, foam-like structure being formed, which displaced a corresponding volume of sand in the sand bed. During this operation, the non-foamed skin-like inner wall of the mold formed in this way was supported on the inside on the steel powder. On reaching the sintering temperature of the component by further heating, the brittle foam ceramic was crushed (pressed in) by the shrinkage process in the zones close to the surface, the partially broken skeleton of the component however exerting no significant resistance thereto. It was possible to achieve a component having a comparatively smooth surface.

ILLUSTRATIVE EMBODIMENT V

A high-temperature heat exchanger for gaseous media was produced from silicon carbide. The heat exchanger was a box-like body of rectangular cross-section provided with external and internal ribs and having a number of rectangular channels. The dimensions were as follows:

Length in flow direction=400 mm
Width=200 mm
Height=60 mm
Wall thickness=4 mm
Wall thickness of the ribs=2.5 mm A multi-part metal matrix having approximately the final shape of the component was coated on the outside, by flame-spraying, with an approximately 0.8 mm thick layer of $Al_2O_3$ as outer mold shell. Prismatic, rectangular cores for the channels, provided with grooves for the ribs, were then produced. The material used for this purpose was mullite ($3Al_2O_3.2SiO_2$) in coarse-grained powder form with a particle diameter of 200 to 500 μm, to which a few percent by weight of quartz ($SiO_2$) were admixed as binder.

The yielding ceramic mold comprising several $Al_2O_3$ shell parts and mullite cores was now filled with SiC powder having a particle size of 30 to 80 μm, with vibration, and the whole was subjected to a heat treatment programed over time. First, for the purpose of drying and driving off volatile contaminants and gases, heating was carried out at a rate of 100° C./h to a temperature of 300° C. and the temperature was kept at this value for about ½ h. Further heating to 1,000° C. was effected as 200° C./h and that to 1,100° C. at a reduced rate of 20° C./h, in order to allow time for the transformations to be expected (phases, modifications of the $SiO_2$, etc.) and the resulting volume changes in the substances involved. Heating was then carried out at 200° C./h to 1,500° C. and this temperature was maintained for 2 h. During this operation the mullite already started to soften somewhat, so that it did not hinder the shrinkage of the silicon carbide component to be produced during the sintering process, which now started. This process was now carried out at a temperature of 1,600° C. for a period of 8 h. During this process the cores shrank and the outer shell of the mold ($Al_2O_3$. remained intact. After the sintering process was complete, cooling was carried out relatively rapidly (quenching), the outer shell of the mold being forced to break away, whilst the cores crumbled. With this example it was possible to show that even comparatively complex components can be produced economically from ceramic materials by the present process.

The invention is not restricted to the illustrative embodiments.

The process for shaping any desired component made of a metallic and/or ceramic material using a powder or a powder mixture as the starting material, the powder being filled loosely into a mold and then subjected to a sintering process, is carried out in that the mold used is a yielding ceramic body which yields elastically and/or plastically and/or cracks at predetermined breaking points provided in a targeted manner, under the stresses which arise during the rise in temperature and during sintering as a consequence of expansion or shrinkage and cause tensile and/or compressive forces, its strength and dimensional stability, however, being sufficiently high, considered in the entire temperature range and over the entire course of the process, to ensure a high dimensional accuracy of the component to be produced as a sintered compact. The mold used is one or more thin, resilient ceramic shells made of $Al_2O_3$, $SiO_2$ or MgO of high porosity or a body made of a special glass, which on reaching the sintering temperature of the powder mixture intended for the component cracks in a network-like manner, without completely bursting into pieces or disintegrating.

Preferably, the mold used is a ceramic body which has predetermined breaking points in the form of notches at the locations of maximum tensile stresses which arise in the course of the sintering process, and also a ceramic shell, which cracks during sintering of the component and disintegrates into arbitrary mosaic-like fragments.

In another variant, the mold used is a thin, flexible, elastic-plastic ceramic sheeting in the green or only partially heat-treated state, which sheeting achieves its final strength, by chemical processes and sintering to completion, only in the course of the heating and sintering process together with the powder used to produce the component.

Advantageously, the mold used is a green ceramic composition which assumes its final shape and strength only during the drying and sintering process at the same time as the sintering of the component takes place, it being necessary, during the shrinkage process associated therewith, to absorb only the positive or negative difference forces caused by the different shrinkage of mold and component. Particularly advantageous conditions exist if a material is used for the ceramic composition which has a contraction which during the shrinkage caused by the heating and the sintering of mold and component is greater than the contraction of the powder used for the component, in such a way that a pressure is exerted on the component during the sintering process, whilst the wall of the mold is under tensile stress.

Preferably, the powder or the powder mixture is pre-compacted by centrifuging in the yielding mold before heating to the sintering temperature or during the first phase of heating in the lower temperature range.

Obviously, numerous modifications and variations of the present invention are possible in the light of the above teachings. It is therefore to be understood that within the scope of the appended claims, the invention may be practiced otherwise than as specifically described herein.

What is claimed and desired to be secured by Letters Patent of the United States is:

1. A process for making a component of a metallic and/or ceramic material, comprising the steps of:

(a) preparing a powder or a powder mixture as a starting material; f (b) filling the starting powder loosely into a mold of a body which yields elastically and/or plastically and/or cracks under stresses which arise during a rise in temperature;

(c) placing the mold and the starting material in a furnace;

(d) heating the mold and the starting material free of an external pressure to a temperature at which sintering of the starting material takes place wherein a time/temperature program of the heating is controlled in such a way that the shrinkage of the starting material and of the mold take place at an approximately equal rate and equal extent;

(e) cracking the mold at least partially after the strength and dimensional stability of the at least pre-sintered starting material is sufficiently high to ensure a high dimensional accuracy of the component to be made as a sintered compact; and (f) removing the at least partially cracked mold from the component.

2. The process as claimed in claim 1, wherein the mold used is one or more thin, resilient ceramic shells made of $Al_2O_3$, $SiO_2$ or MgO of high porosity.

3. The process as claimed in claim 1, wherein the mold used is a body made of a special glass, which on reaching the sintering temperature of the powder mixture intended for the component cracks in a network-like manner, without completely bursting into pieces or disintegrating.

4. The process as claimed in claim 1, wherein the mold used is a ceramic body which has predetermined breaking points in the form of notches at the locations of maximum tensile stresses which arise in the course of the sintering process.

5. The process as claimed in claim 1, wherein the mold used is a ceramic shell, which cracks during sintering of the component and disintegrates into arbitrary mosaic-like fragments.

6. A process for shaping any desired component made of a metallic and/or ceramic material using a powder or a powder mixture as the starting material, the powder being filled loosely into a mold and then subjected to a sintering process, wherein the mold used is a yielding ceramic body which yields elastically and/or plastically and/or cracks at predetermined breaking points provided in a targeted manner, under the stresses which arise during the rise in temperature and during sintering as a consequence of expansion or shrinkage and cause tensile and/or compressive forces, its strength and dimensional stability being sufficiently high, considered in the entire temperature range and over the entire course of the process, to ensure a high dimensional accuracy of the component to be produced as a sintered compact, the mold comprising a thin, flexible, elastic-plastic ceramic sheeting in the green or only partially heat-treated state, which sheeting achieves its final strength, by chemical processes and sintering to completion, only in the course of the heating and sintering process together with the powder used to produce the component.

7. A process for shaping any desired component made of a metallic and/or ceramic material using a powder or a powder mixture as the starting material, the powder being filled loosely into a mold and then subjected to a sintering process, wherein the mold used is a yielding ceramic body which yields elastically and/or plastically and/or cracks at predetermined breaking points provided in a targeted manner, under the stresses which arise during the rise in temperature and during sintering as a consequence of expansion or shrinkage and cause tensile and/or compressive forces, its strength and dimensional stability being sufficiently high, considered in the entire temperature range and over the entire course of the process, to ensure a high dimensional accuracy of the component to be produced as a sintered compact, the mold comprising one or more thin, resilient ceramic shells made of $Al_2O_3$, $SiO_2$ or MgO of high porosity, the mold comprising a green ceramic composition which assumes its final shape and strength only during the drying and sintering process at the same time as the sintering of the component takes place, it being necessary, during the shrinkage process associated therewith, to absorb only the positive or negative difference forces caused by the different shrinkage of mold and component.

8. The process as claimed in claim 7, wherein a material is used for the ceramic composition which has a contraction which during the shrinkage caused by the heating and the sintering of mold and component is greater than the contraction of the powder used for the component, in such a way that a process, whilst the wall of the mold is under tensile stress.

9. A process for shaping any desired component made of a metallic and/or ceramic material using a powder or a powder mixture as the starting material, the powder being filled loosely into a mold and then subjected to a sintering process, wherein the mold used is a yielding ceramic body which yields elastically and/or plastically and/or cracks at predetermined breaking points provided in a targeted manner, under the stresses which arise during the rise in temperature and during sintering as a consequence of expansion or shrinkage and cause tensile and/or compressive forces, its strength and dimensional stability being sufficiently high, considered in the entire temperature range and over the entire course of the process, to ensure a high dimensional accuracy of the component to be produced as a sintered compact, the powder or the powder mixture being pre-compacted by centrifuging in the yielding mold before heating to the sintering temperature or during the first phase of heating in the lower temperature range.

10. The method of claim 1, wherein the heating step to sinter the component is carried out under a vacuum atmosphere.

11. The method of claim 1, wherein the starting material and the mold are free of an external pressure throughout steps (d), (e) and (f).

12. The method of claim 1, wherein the mold is porous and the starting powder is filled into the porous mold.

13. The method of claim 1, further comprising placing the mold in a bed of sand and the heating step is performed with the mold in the bed of sand.

14. The method of claim 1, wherein volatile contaminants and gases are removed from the mold and starting powder during the heating step.

15. The method of claim 1, further comprising subjecting the sintered component to container-free hot-isostatic pressure.

16. The method of claim 1, further comprising exerting pressure on the component's surface at a point during the heating step at which the mold has partially burst and other parts of the mold are softened.

* * * * *